US005930959A

United States Patent [19]

van Halteren

[11] Patent Number: 5,930,959

[45] Date of Patent: Aug. 3, 1999

[54] METHOD FOR APPLYING A GROUND ANCHOR INTO THE GROUND, AND ANCHOR TO BE USED THEREWITH

[76] Inventor: Tijmen van Halteren, Dorpsweg 142, 3751, Et Bunschoten, Netherlands

[21] Appl. No.: 09/011,184

[22] PCT Filed: Aug. 2, 1996

[86] PCT No.: PCT/NL96/00314

§ 371 Date: Feb. 2, 1998

§ 102(e) Date: Feb. 2, 1998

[87] PCT Pub. No.: WO97/06310

PCT Pub. Date: Feb. 20, 1997

[30] Foreign Application Priority Data

Aug. 7, 1995 [NL] Netherlands ..... 1000941

[51] Int. Cl.[6] ..... E02D 5/80

[52] U.S. Cl. ..... 52/157; 52/148

[58] Field of Search ..... 52/157, 148

[56] References Cited

U.S. PATENT DOCUMENTS

| | | | |
|---|---|---|---|
| 1,283,246 | 10/1918 | Maloney | 52/157 |
| 1,502,965 | 7/1924 | Seyler | 52/148 |
| 2,603,319 | 7/1952 | Dyche | 189/91 |
| 2,999,572 | 9/1961 | Hinckley | 52/157 |
| 3,089,567 | 5/1963 | Sullivan | 52/148 |
| 3,710,523 | 1/1973 | Taylor | 52/157 |
| 3,797,283 | 3/1974 | Honer | 52/157 |
| 4,316,350 | 2/1982 | Watson | 52/157 |
| 4,727,693 | 3/1988 | Rockenfeller et al. | 52/163 |
| 4,863,137 | 9/1989 | Cockman et al. | 52/157 |

FOREIGN PATENT DOCUMENTS

| | | | |
|---|---|---|---|
| 961237 | 1/1975 | Canada | 52/157 |
| 85 19 054 | 10/1985 | Germany | E02D 5/80 |

*Primary Examiner*—Carl D. Friedman
*Assistant Examiner*—Phi Dieu Tran A
*Attorney, Agent, or Firm*—Michael D. Bednarek; Crowell & Moring LLP

[57] ABSTRACT

A method for introducing a ground anchor into the ground, comprising the step of screwing an elongate anchor body into the ground by means of an extension tube that is to be connected to the proximal end of said anchor body. The distal end of a tension line is connected to the anchor body at a location that is positioned between the two ends of the anchor body and excentrically relative to the cross section of the latter. The tension line extends outwardly through the connected extension tube. The extension tube is unscrewed from the anchor body after the latter having arrived at a predetermined depth. A pulling load is then applied to the free proximal end of the tension line, said load being large enough to cause the anchor body to turn through the ground about the attachment point of the tension line, after which the proximal end of the line is attached to the structure to be stabilized.

14 Claims, 1 Drawing Sheet

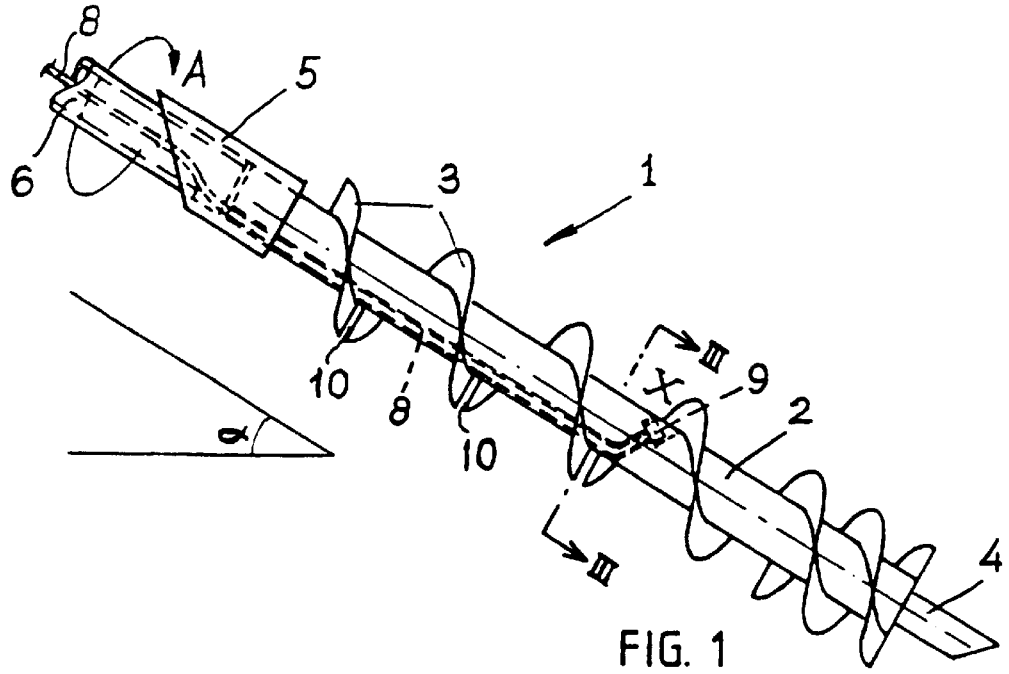
FIG. 1
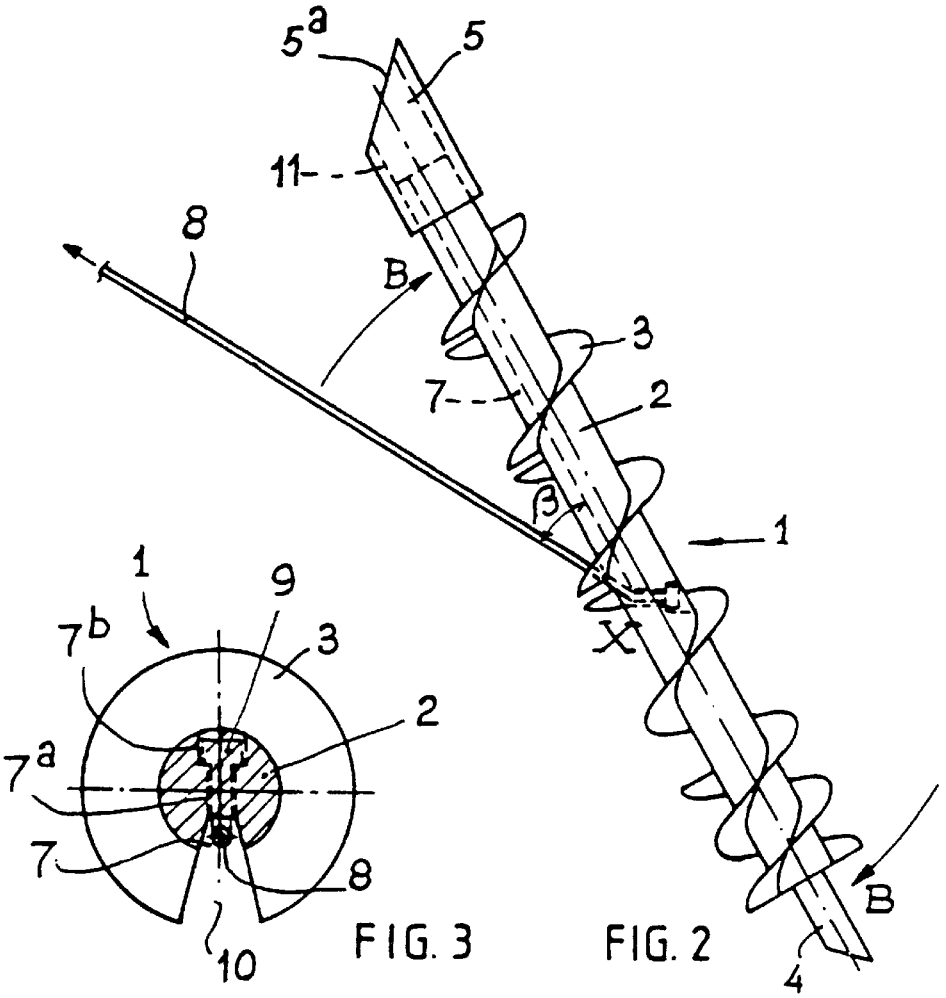
FIG. 3
FIG. 2

METHOD FOR APPLYING A GROUND ANCHOR INTO THE GROUND, AND ANCHOR TO BE USED THEREWITH

FIELD OF THE INVENTION

The invention relates to a ground anchor device and method for introducing a ground anchor into the ground. These types of devices and methods have been used, for example, for the stabilizing of permanent and temporary sheet-pile walls, wherein such walls have been set into the ground with the anchors being at a predetermined distance away from the walls.

BACKGROUND OF THE INVENTION

U.S. Pat. No. 2,603,319 discloses a method of introducing a ground anchor into the ground, comprising the step of screwing an elongated anchor body into the ground by rotating an extension tube that is connected with its distal end to the proximal end of the anchor body.

In a frequently and successfully applied embodiment of the well-known method, an anchor body having a hollow core and screw blades is used to secure a structure, such as an aggregate of building materials, e.g., sheet-piles. After this anchor body has been screwed into the ground, a setable mortar is introduced. The mortar is forced through the extension tube and the hollow space of the anchor body into the ground. i.e., the earth, between the screw blade windings to form, together with said earth, a solid mass. Thus, the anchor body becomes fixedly anchored.

The extension tubes form a permanent part of the anchor and are attached to the sheet-pile wall, with the proximal end of the uppermost extension tube extending through a hole in the sheet-pile wall and through a corresponding hole in an anchoring support member that is provided on the outer side of the sheet-pile wall.

In general, the insertion of the ground anchors into the ground is started only after the sheet-pile wall is completed because the introduction of the individual sheet-piles involves powerful vibrations, which are transmitted through the earth. If one were to start the introduction of the ground anchors, while continuously driving additional sheet-piles into the ground, these vibrations would prevent an effective setting process of the setable mortar, so that the required pull out load resistance would not be obtained.

SUMMARY OF THE INVENTION

It is an object of the invention to improve the well-known method in the sense, that the introduction of the ground anchors may begin before the structure to be stabilized (i.e. sheet-pile wall) has been completed, and if desired, immediately upon the introduction of each next sheet-pile or group of sheet-piles, so that the overall time required for driving constructions, such as sheet-pile walls, into the ground and anchoring the same, may be substantially reduced.

According to the invention, this aim is achieved in that the distal end of a line of sufficient tensile strength is connected to the anchor body at a location that is positioned between the two ends of the anchor body and excentrically, relative to the cross section of the anchor body. The tension line extends outwardly through the connected extension tube, wherein the extension tube being unscrewed from the anchor body after it has arrived at a predetermined depth. Such depth is that which is commonly recognized within the field of invention as that which would ensure the stability of the structure being stabilized, i.e., the depth at which a pulling load would be below that which would be necessary to completely pull out the ground anchor. A pulling load is subsequently applied to the free proximal end of tension, while line remaining connected to the anchor body. The intensity of the pulling load being such that it causes the anchor body to perform a turning movement through the ground about the attachment point of said line, after which movement the proximal end of said line is attached to the structure to be stabilized.

By causing the anchor body to turn under the influence of the pull load exerted at the proximal end of the line, the axis of the anchor body will become positioned at an angle relative to the line, so that its resistance to being pulled out increases. The ultimate resistance to the pulling out of the anchor body will be higher according to the pulling load on the line being greater and thereby the angle between the axis of the anchor body becoming larger.

The use of a setable mortar commonly used in the prior art, as mentioned above, is omitted and thereby permits the ground anchors to be positioned each time immediately after the last sheet-pile is driven into the ground.

By placing a ground anchor into the ground at the location of each sheet-pile, use can be made of ground anchors having a relatively low tensile strength. At the same time, supporting beams are no longer required to be placed along the outer side of the sheet-pile wall, as is required when using ground anchors at spacings that are many times larger than the width of a sheet-pile.

The invention also relates to a ground anchor to be used in the method mentioned above, such ground anchor comprises an elongate anchor body, having a core rod with two or more screw blades, wherein the rod having its proximal end removably connected, by means of a coupling sleeve, to the distal end of an extension tube. Such an anchor is known in the prior art.

The ground anchor according to the present invention is characterized by a tension line extending along the core rod of the anchor body, the line having its distal end anchored to the core rod at a location within a central area of said rod. The line extending from said coupling sleeve into the extension tube and outwardly through the proximal end of the anchor body. The screw blade extends from the core rod being slitted according to a plane substantially going through the axis of the anchor body, such that after removal of the extension tube, the line may swing about its anchoring location and through the slit(s) outwardly.

The invention will be hereinafter further explained by way of example with reference to the drawing.

BRIEF DESCRIPTION OF DRAWINGS

FIG. 1 is a side view of an anchor, according to the present invention, in a position at an elevational angle $\alpha$, that is taken by the anchor body relative to the horizontal plain during its introduction into the ground.

FIG. 2 is a side view of the anchor of FIG. 1, after the anchor body having arrived at the desired depth, the extension tube is unscrewed and removed, and with a pulling force being exerted onto the tension line.

FIG. 3 is a cross-sectional view at an increased depicted scale, along the line III—III of FIG. 1.

DESCRIPTION OF THE PREFERRED EMBODIMENTS

The anchor shown in FIG. 1 of the drawing has to be driven into the ground under an elevational angle $\alpha$, e.g., 25–40°. It comprises an anchor body 1 in the form of a core rod 2 that is provided with a screw blade 3 in a well-known manner and terminates at its distal end into a beveled frog 4.

A longitudinal recess 7 is provided in the surface of the core rod 2 to accommodate a steel wire cable 8. The longitudinal recess 7 extends through a part of the length of the core rod, vz. from the proximal end of it (positioned within the coupling sleeve) up to a location X at the cross sectional plane III—III. From the location X the longitudinal recess 7 continues in the form of a passage 7*a* that extends obliquely to the opposite longitudinal side of the core rod 2. The distal end portion of the cable 8, that bends inwardly through said passage 7*a*, is anchored in the widened end 7*b* of the passage 7*a*, e.g., by means of a thickening 9 swaged on the distal end of it.

The screw blade 3 is interrupted at the longitudinal recess 7 by radially outwardly extending slits 10, which extend out from the core rod's vertical axis. Such slits communicate with said recess and merge into the periphery of the screw blade 3. The coupling sleeve 5 is provided with a longitudinal slit 11 that corresponds with the longitudinal recess 7.

In the situation shown in FIG. 1 the cable 8 is locked in place within the longitudinal recess 7 and within the extension tube 6, being screwed into the coupling sleeve, respectively. The cable leaves the extension tube 6 at the proximal end (not shown in the drawing) of said extension tube.

In this state, the anchor is driven in a well-known manner, under the desired elevational angle $\alpha$ into the ground by rotating it in the arrow direction A.

After the ground anchor has arrived at the predetermined depth, the extension tube 6 is unscrewed by rotating it in a direction opposite to the arrow A, and then pulled out of the ground, after which a pulling load is applied at the proximal end of the wire cable 8, for example a steel wire, (see FIG. 2) under the influence of which the anchor body 1 is turned about the anchoring location X in the arrow direction B, while allowing the cable 8 to move out of its seat 7 and through the longitudinal slit 11 and the radial slits 10. As explained herein above, the ultimate resistance to the pulling out of the anchor body will become higher, as the pulling load-on the wire cable, for example a steel wire, (functioning as a permanent anchoring line) is increased and thereby increasing the angle $\beta$ between the axis of the anchor body 1 and the line 8.

As shown in the drawing yet, the coupling sleeve 5 may be inwardly beveled at its distal end 5*a* in a direction B to promote the turning movement of the anchor body 1 in the arrow direction.

I claim:

1. A method of introducing a ground anchor into the ground comprising the steps of:

screwing an elongate anchor body into the ground by making use of an extension tube that is connected to the proximal end of said anchor body and then rotated until the anchor body has reached a desired depth;

fastening an anchor line of sufficient tensile strength with its distal end to the anchor body at a location that is positioned excentrically relative to the cross-section of the anchor body and at an intermediate point of the length of the latter, said line being held to extend from said fastening location upwardly alongside the proximal portion of the anchor body and further upwardly while screwing the anchor body down;

characterized by the additional steps of causing the anchoring line to extend from along-side at the proximal end of the anchor body into and through the extension tube connected thereto;

unscrewing the extension tube from the anchor body and removing it from said anchoring line after the anchor body has arrived at the desired depth; and applying a pull load to the free proximal end of the anchoring line which is large enough to cause said anchor body to perform a tilting movement through the ground around said fastening location, after which movement the proximal end of said anchor line is attached to the structure to be anchored.

2. The method of claim 1, wherein the ground anchor comprises:

an elongate anchor body having a core rod, the core rod being provided with two or more screw blades;

an extension tube, having its distal end removably connected, by means of a coupling sleeve, with the proximal end of the core rod of the anchor body;

an anchoring line having its distal end secured to the anchor body at a location that is positioned excentrically relative to the cross section of the anchor body and at an intermediate point of the length of the latter;

wherein said anchoring line extends from said securing location first alongside the core rod of the anchor body towards the proximal end of the latter and then from the proximal end of the core rod into and through the extension tube;

wherein the connection between the said core rod and said extension tube is a threaded sleeve connection;

wherein the screw blades located on the core rod length between said securing location and the proximal end of the core rod are radially outwardly slotted in a plane that substantially goes through the axis of the anchor body and through said securing location; and further wherein unscrewing and removal of said extension tube enables said anchoring line to escape through the radial slits of the screw blades outwardly and thereby allow the anchor body to tilt about said securing location relative to said line.

3. The method according to claim 2, wherein:

a longitudinal recess is provided in the surface of the core rod, said recess extending from the proximal end of the latter up to said securing location and serving as a seat for the said line.

4. The method according to claim 3, wherein:

the longitudinal recess continues at the securing location in the form of a passage that extends obliquely through and towards the opposite side of the core rod, where the distal end of the line is anchored in the free and widened end of said passage.

5. A ground anchor according to claim 2, wherein:

the slits in the screw blades have an outwardly increasing width.

6. The method according to claim 2, wherein:

the coupling sleeve is permanently attached to the proximal end of the core rod and is provided with a longitudinal slit in alignment with the recess for the anchoring line along the core rod.

7. The method according to claim 6, wherein:

the proximal end of the coupling sleeve being beveled.

8. A method for inserting a ground anchor into the ground, comprising the steps of:

connecting an extension tube to a proximal end of an elongated anchor body having distal and proximal ends;

screwing the anchor body into the ground with the extension tube;

connecting a tension line having a distal end to the anchor body at a location between the two ends of the anchor body and excentrically relative to the cross section of the anchor body, wherein the tension line extends through the connected extension tube;

unscrewing the extension tube from the anchor body when the anchor body reaches a predetermined depth; and applying a tensile load to the proximal end of the tension line connected to the anchor body, at an attachment point, wherein the intensity of the tensile load being such that the load causes the anchor body to perform a turning movement in the ground about the attachment point of the tension line, after which, the proximal end of the tension line is attached to a structure to be stabilized.

9. A ground anchor comprising:

an elongated anchor body;

the anchor body having proximal and distal ends;

an extension tube having proximal and distal ends;

wherein a core rod having proximal and distal ends;

wherein a coupling sleeve having proximal and distal ends;

wherein a tension line having proximal and distal ends;

wherein the anchor body having a core rod with at least two screw blades;

wherein the core rod having the proximal end removably connected by the coupling sleeve to the distal end of the extension tube;

wherein the tension line extending along the core rod of the anchor body;

wherein the tension line being connected by its distal end at an attachment point within the core rod;

wherein the attachment point being further positioned between the two ends of the anchor body;

wherein the tension line extending from the coupling sleeve into the extension tube and through the proximal end of the core rod;

wherein the screw blades radially extending out from the core rod's vertical axis;

wherein the core rod having a longitudinal slit along a vertical plane passing through the vertical axis of the anchor body, such that after removal of the extension tube, the tension line is capable of movement about the attachment point and outward through the slit; and each blade having a radially extending slit corresponding to the longitudinal slit of the core rod.

10. A ground anchor according to claim 9, wherein a longitudinal recess is provided in the surface of the core rod; and the recess extends from the proximal end to the attachment point located between the two ends of the core rod so as to serve as a seat for the tension line.

11. A ground anchor according to claim 10, wherein the longitudinal recess in the surface of the core rod continues at the attachment point;

further wherein the recess is in the form of a passage that extends linearly therethrough towards an opposite side of the core rod; and the distal end of the tension line is attached within the passage.

12. A ground anchor according to claim 9, wherein the slit increases radially in width.

13. A ground anchor according to claim 9, wherein the coupling sleeve is permanently provided on the proximal end of the core rod and includes a longitudinal slit vertically aligned with the recess along the core rod.

14. A ground anchor according to claim 13, wherein the proximal end of the coupling sleeve is beveled.

* * * * *